US006289557B1

(12) United States Patent
Manson et al.

(10) Patent No.: US 6,289,557 B1
(45) Date of Patent: Sep. 18, 2001

(54) SANITARY DOOR HANDLE ASSEMBLY

(76) Inventors: Barry F. Manson, 21 Boone Trail, Severna Park, MD (US) 21146; Ralph G. Ridenour, 626 Lexington-Ontario Rd., Mansfield, OH (US) 44903

( * ) Notice: Subject to any disclaimer, the term of this patent is extended or adjusted under 35 U.S.C. 154(b) by 0 days.

(21) Appl. No.: 09/457,174

(22) Filed: Dec. 8, 1999

Related U.S. Application Data

(60) Provisional application No. 60/112,192, filed on Dec. 15, 1998.

(51) Int. Cl.[7] ..... E05B 1/00; E05B 5/00

(52) U.S. Cl. ..... 16/412; 16/413; 16/901; 16/904; 16/430

(58) Field of Search ..... 16/412, 413, 430, 16/901, 904; 49/460; 292/347; 294/26, 51; D8/306, 307, 308, 300, DIG. 1

(56) References Cited

U.S. PATENT DOCUMENTS

| | | | | |
|---|---|---|---|---|
| D. 199,333 | * | 10/1964 | Finley . | |
| D. 378,490 | * | 3/1997 | Campbell et al. . | |
| 945,461 | * | 1/1910 | Hubbard . | |
| 1,055,925 | * | 3/1913 | Lathrop . | |
| 1,487,264 | * | 3/1924 | Raymer . | |
| 2,005,576 | * | 6/1935 | Buhl et al. . | |
| 2,238,513 | * | 4/1941 | Ward . | |
| 2,439,057 | * | 4/1948 | Russell . | |
| 2,541,720 | * | 2/1951 | Robinson . | |
| 2,581,606 | * | 1/1952 | Seaman et al. . | |
| 2,832,623 | * | 4/1958 | Golemon . | |
| 2,835,524 | | 5/1958 | Russell . | |
| 2,904,368 | | 9/1959 | Taubman . | |
| 3,095,225 | | 6/1963 | Domsic et al. . | |
| 3,121,907 | | 2/1964 | Stebbins . | |
| 3,152,818 | | 10/1964 | Ivins . | |
| 3,156,977 | | 11/1964 | Logan . | |
| 3,387,876 | * | 6/1968 | Lyons, Jr. | 16/413 |
| 3,391,674 | * | 7/1968 | Burleigh | 16/413 |
| 3,536,287 | | 10/1970 | Kramer . | |
| 3,706,164 | | 12/1972 | Glause et al. . | |

(List continued on next page.)

FOREIGN PATENT DOCUMENTS

| | | | |
|---|---|---|---|
| 357167 | * | 11/1961 | (CH) . |
| 547553 | | 4/1932 | (DE) . |
| 302776 | * | 1/1929 | (GB) . |
| 654 890 | * | 7/1951 | (GB) . |
| 1017671 | * | 1/1966 | (GB) . |
| 2038981 | * | 7/1980 | (GB) . |

*Primary Examiner*—Chuck Y. Mah
(74) *Attorney, Agent, or Firm*—Pearne & Gordon LLP

(57) ABSTRACT

A sanitary door handle assembly which can be readily engaged by the inner curvature of a person's wrist or forearm so as to permit hands-free inward opening of a door for sanitary passage, followed by passive, easy release. A mounting arm supports an arcuate handle in spaced relation to the face of the door. The dished side of the handle, which is engaged by the wrist or forearm, generally faces the face of the door. The free end of the handle is directed toward the outer swinging edge of the door, and a gap between the free end of the handle and the door permits the operator's hand to pass therethrough to allow for natural disengagement and passage once the door is pulled open. In a modified arrangement, a resilient member is arranged to permit deflection of the mounting arm and/or handle to accommodate the operator's engaged wrist or forearm in response to unexpected motion of the door.

32 Claims, 4 Drawing Sheets

U.S. PATENT DOCUMENTS

| | | | | |
|---|---|---|---|---|
| 3,827,739 | * | 8/1974 | Overholser | 16/413 |
| 3,965,528 | * | 6/1976 | Kissler | 16/413 |
| 4,045,824 | | 9/1977 | Weppler . | |
| 4,046,508 | | 9/1977 | McDonald . | |
| 4,161,924 | | 7/1979 | Welker . | |
| 4,171,596 | | 10/1979 | Varlonga . | |
| 4,187,640 | | 2/1980 | Freilev . | |
| 4,301,558 | | 11/1981 | Decaux . | |
| 4,301,828 | | 11/1981 | Martin, Jr. . | |
| 4,307,923 | | 12/1981 | Raz . | |
| 4,345,343 | | 8/1982 | Shipman . | |
| 4,442,630 | | 4/1984 | Radek . | |
| 4,512,597 | | 4/1985 | Nabb et al. . | |
| 4,644,689 | | 2/1987 | Arians . | |
| 4,648,637 | | 3/1987 | Walter . | |
| 4,658,469 | | 4/1987 | Hawkins . | |
| 4,710,634 | | 12/1987 | Brookes . | |
| 4,772,054 | | 9/1988 | Schreiber et al. . | |
| 4,817,239 | | 4/1989 | Campbell et al. . | |
| 4,856,140 | | 8/1989 | Visco et al. . | |
| 4,896,144 | | 1/1990 | Bogstad . | |
| 4,942,631 | | 7/1990 | Rosa . | |
| 4,944,478 | | 7/1990 | Sullivan . | |
| 4,997,139 | | 3/1991 | Menard . | |
| 5,052,252 | | 10/1991 | Szymber et al. . | |
| 5,265,924 | | 11/1993 | Kim . | |
| 5,307,528 | | 5/1994 | Nieuwenhuis et al. . | |
| 5,375,295 | * | 12/1994 | Woodward | 16/413 |
| 5,398,374 | | 3/1995 | Betancourt . | |
| 5,405,043 | | 4/1995 | Meloney . | |
| 5,450,889 | | 9/1995 | Jones et al. . | |
| 5,534,346 | | 7/1996 | Robinson . | |
| 5,564,806 | | 10/1996 | Keisling et al. . | |
| 5,603,184 | | 2/1997 | Campbell et al. . | |
| 5,647,074 | | 7/1997 | White, Jr. et al. . | |
| 5,983,454 | * | 11/1999 | Hartselle, III . | |

* cited by examiner

SANITARY DOOR HANDLE ASSEMBLY

This application discloses and claims subject matter disclosed in copending provisional application No. 60/112,192, filed Dec. 15, 1998.

BACKGROUND

This invention relates to handles for doors and, in particular, to handles which can be operated so as to minimize or prevent the spread of hand-borne contaminants.

Door handles, especially those in public spaces, tend to be soiled with many substances transferred from people's hands, especially the hands of those who may not practice optimum hygiene. Among these contaminants are skin oils and common dirt, and potentially more harmful substances such as bacteria, fungi and other pathogens. The contaminants easily can be transmitted to the hand of anyone who grasps the handle to open the door.

If the epidermis of the hand is not intact (e.g., due to lacerations, abrasions, allergies, etc.), there is a high probability that percutaneous (i.e., through the skin into the bloodstream) exposure to pathogens can occur. If the epidermis of the hand is intact, it serves as a barrier to prevent a percutaneous exposure from occurring. However, the contaminants may remain viable on the hand and cause infection through the mucous membranes of the eyes, nose or mouth if these areas are contacted before thorough washing of the hand takes place.

In facilities where a high degree of sanitation is essential, such as in hospitals, many doors are opened by mechanisms which are activated either automatically by sensors which detect an approaching person, or by a push-button near the door which can be pressed by an elbow or shoulder. However, the high cost of these door opening devices precludes their use on every door in a sanitary facility.

Simpler and less costly solutions have been proposed. See, for example, Ward U.S. Pat. No. 2,238,513, and Campbell U.S. Pat. No. 4,817,239 which disclose hook-like door handles that are intended for engagement by a person's forearm. However, it would seem that such handles are not well adapted for natural and comfortable engagement by a wrist, or natural and easy disengagement once the door has been pulled open.

SUMMARY OF THE INVENTION

The present invention to provide a sanitary door handle assembly which can be readily engaged by the inner curvature of a person's wrist or forearm so as to permit hands-free inward opening of a door for sanitary passage, followed by passive, easy release. Hand operation of the door is possible but the sanitation benefit is lost.

The invention also provides a sanitary door handle assembly which easily can be mounted on a door and take the place of existing conventional door hardware.

This invention further provides a sanitary door handle assembly which can accommodate persons of different height or strength.

More specifically, this invention includes a door and sanitary door opener assembly for opening the door, the door having an inner hinged edge, an outer swinging edge and faces extending between those edges. These faces are generally but not necessarily parallel. The door may have many shapes. The assembly comprises a mounting arm having a proximal portion supported on one face of the door, and a distal portion spaced from the face of said door; and a handle joined to the distal portion of the mounting arm and extending outwardly toward the outer swinging edge of the door to a free end spaced from the face of the door. The free end of the handle and the face of the door define therebetween a gap at least large enough to permit an operator's hand to pass therethrough. The handle is arcuate with the dished side thereof generally facing the face of the door for natural engagement by the operator's wrist or forearm when pulling the door open, and natural disengagement when the door is open.

A sanitary door opener assembly is adapted for mounting on and opening a door having an inner hinged edge, an outer swinging edge and generally parallel faces extending between those edges. The assembly comprises a mounting arm having a proximal portion and a distal portion, the proximal portion having a base with a mounting surface adapted to be supported on one face of the door. The distal portion is spaced from the plane of the mounting surface so that the distal portion is spaced from the surface of the door when the base in supported on the door.

The assembly further comprises a handle joined to the distal portion of the mounting arm and extending therefrom to a free end spaced from the plane of the mounting surface by a distance greater than the width of an operator's hand. Thus, when the assembly is mounted on the door, the free end of the handle and the face of the door define therebetween a gap at least large enough to permit the operator's hand to pass therethrough, with the free end of the handle projecting toward the outer swinging edge of the door.

The handle is arcuate with the dished side thereof generally facing the base so that the dished side generally faces the face of the door when the base is supported on the door. This allows for natural engagement by the operator's wrist or forearm when pulling the door open, and natural disengagement when the door is open.

The dished side of the handle includes a reentrant portion which an operator's wrist or forearm may work against. This enhances positive engagement of the handle even though it is not gripped by hand.

In one of the illustrated embodiments, the handle assembly is arranged for resilient deflection from its normal mounted or operating position if unexpected movement of the door occurs during opening operation by an operator. For example, when the assembly is engaged for operation from one side of the door and the door is unexpectedly opened from the other side, the assembly or elements thereof deflect to accommodate the unexpected movement instead of applying potential injurious loads to the engaged wrist or forearm.

DETAILED DESCRIPTION OF THE PREFERRED EMBODIMENTS

Figure 1:
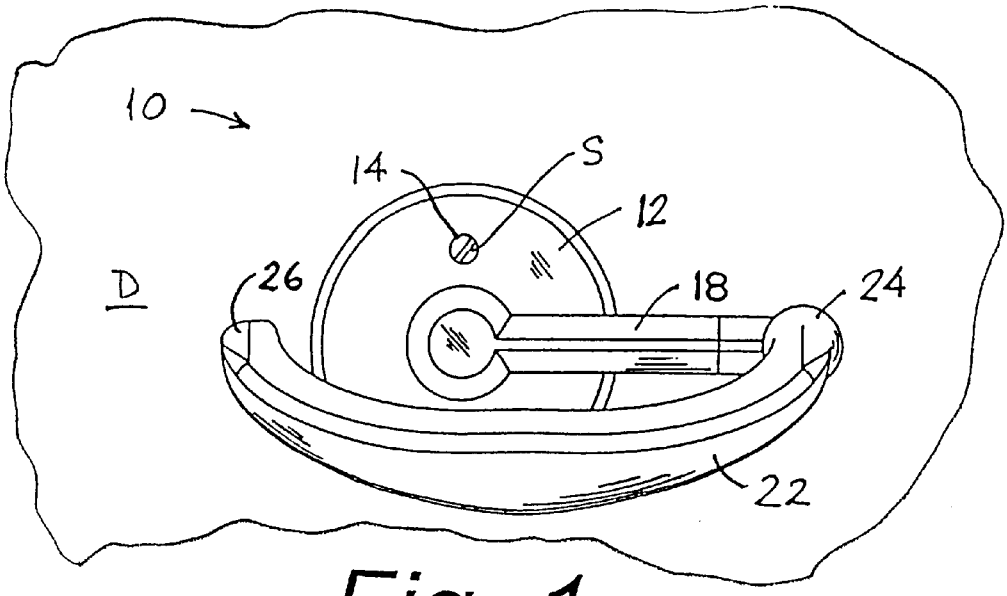
FIG. 1 is a front elevational view of the handle assembly according to a preferred embodiment of the invention, shown mounted on the face of a door.

Referring to the figures, the handle assembly 10 of the invention comprises a circular base 12 having two holes 14 through which the base is attached to the face of a door D by means of screws S at a support location. An L-shaped mounting arm 16 has a base leg 18 which is rigidly attached to base 12 and a portion extending past said support location toward said inner hinged area. A gently curved handle 22 is rigidly attached to the distal end of mounting arm or stem 20 at ball-shaped elbow 24. Handle 22 is approximately 6 to 8 inches long, is thicker in the middle than at its ends, and has a dished surface 25 that generally faces the door. The other end of the handle 26 forms the distal end 26 and extends laterally between the base leg 18 and the swinging edge of the door.

Figure 3:
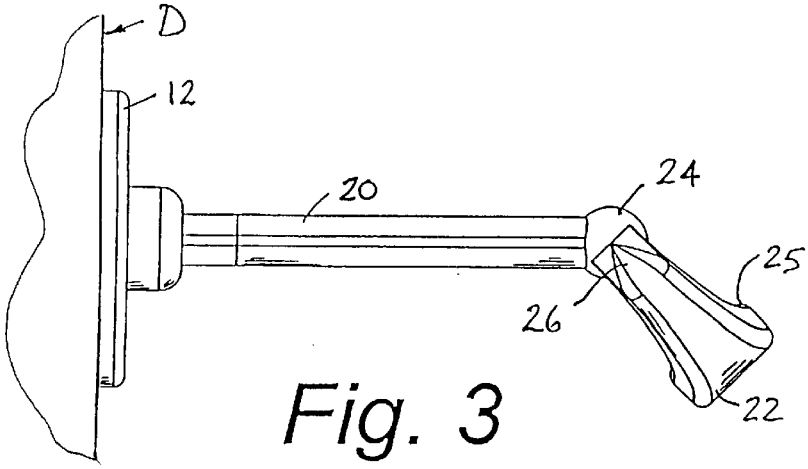
FIG. 3 is a left side elevational view of the handle assembly of FIG. 1.
Figure 4:
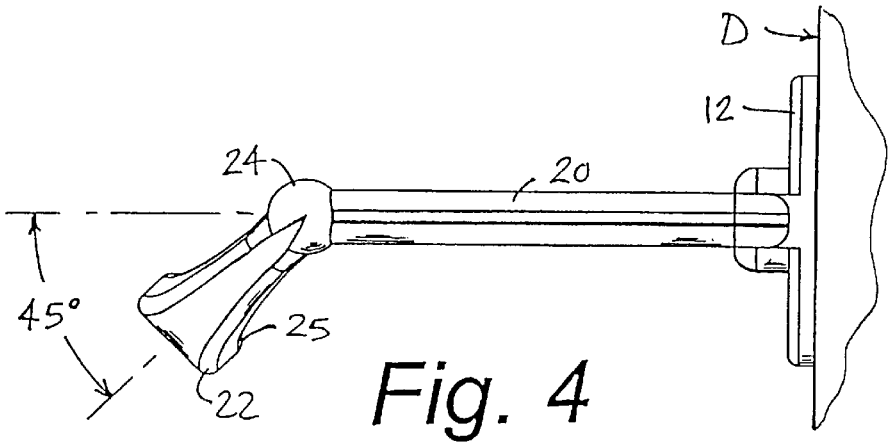
FIG. 4 is a right side elevational view of the handle assembly of FIG. 1.
Figure 5:
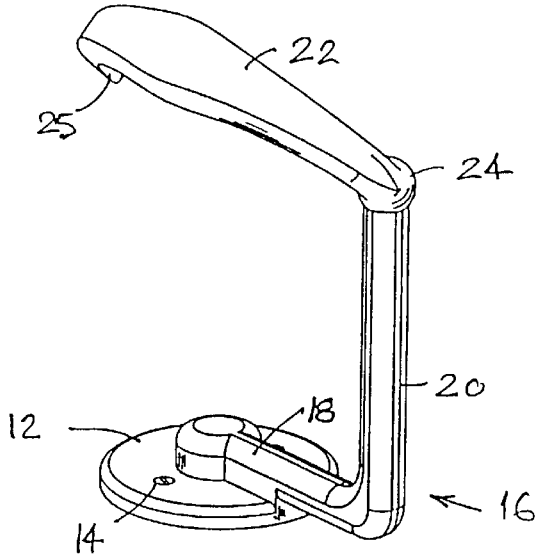
FIG. 5 is a perspective view of the handle assembly of FIG. 1, viewed from below and to the right, and with the handle assembly removed from the door and standing on its base.

As seen in FIGS. 3 and 4, the plane of the handle 22 is oblique relative to the plane of the door D. More particularly, the plane of the handle 22 slants downwardly away from the base and the door at an angle of approximately 45 degrees. This angle may be in the range of 15 to 75 degrees, and more particularly, 30 to 60 degrees.

The angular orientation of the plane of the handle 22 further facilitates the operation of the handle assembly 10. More particularly, the angular orientation of the handle plane better accommodates or receives the wrist or forearm of the operator since the operator's arm will generally be extended downwardly at an angle for purposes of engagement and disengagement. The angular orientation of the plane of the handle and the concave shape of the handle cooperatively define an upwardly opening engagement and disengagement region above the handle that more easily receives the angularly and downwardly depending arm of the door operator.

The handle may be mounted in upwardly oblique or horizontally perpendicular orientations. Thus, the full range of mounting angle of the plane of the arcuate handle as measured along the face of the door is from about 15° to about 165° from the vertical.

Figure 2:
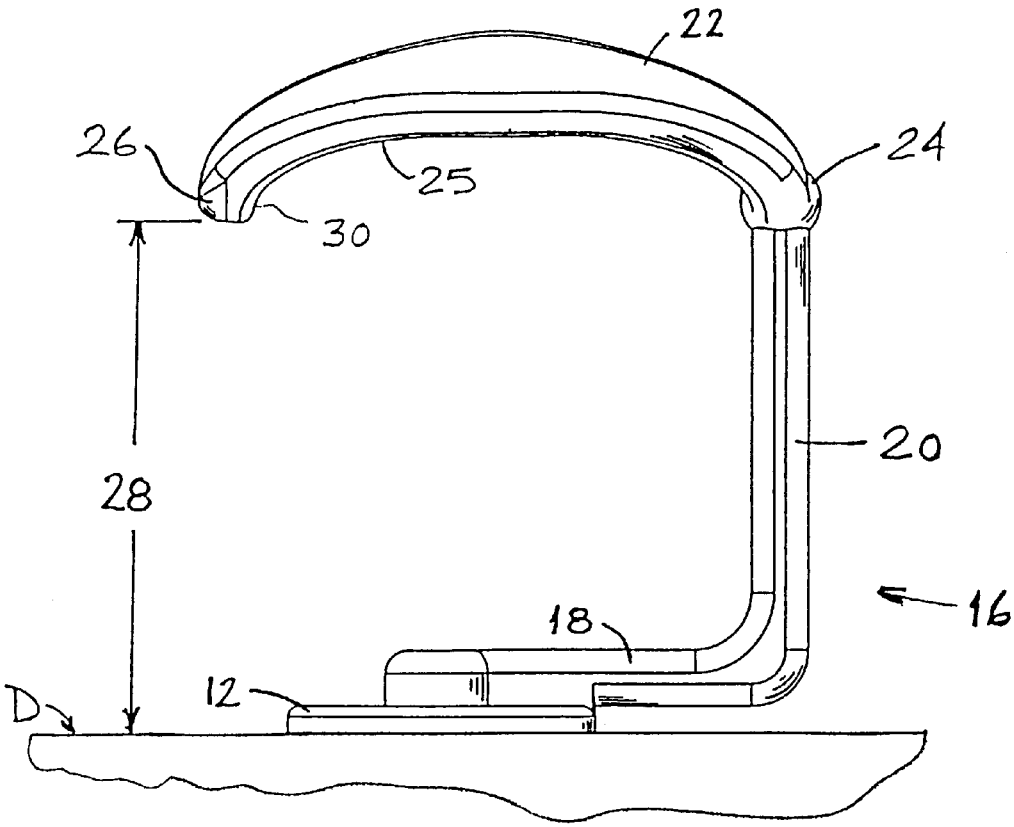
FIG. 2 is a bottom plan view of the handle assembly of FIG. 1.

As seen in FIG. 2, in a typical embodiment the distal end 26 of handle 22 is approximately the same distance from the base or door as elbow 24. Stem 20 is usually at least 4 inches long to provide sufficient hand clearance (whether the hand is open or closed in a fist) at the opening 28 between the distal end 26 of handle 22 and the door. Shorter stems could be used in special cases. The center of the arcuate handle 22 is approximately one to three inches further from the base or door than the distal end 26. Accordingly, the ratio of the handle length to the arcuate depth or concavity is in the range of two to eight. Further, the total distance from the face of the door to the center of the arcuate handle 22 ranges from about five to about eight inches. Other ratios are usable.

The foregoing dimensions and ratios have been found to enable ready wrist or forearm engagement for door opening and easy withdrawal of the wrist or forearm when the door is open. The shape of the dished or concave surface 25 also makes for comfortable engagement by a wrist or forearm. Also, the downward slope particularly facilitates release since the adult user will typically withdraw his wrist or forearm with an upward motion. Thus, handle 22 can be readily engaged by a person's wrist or forearm and pulled so as to permit comfortable and natural hands-free inward opening of the door, followed by passive, easy release.

The handle 22 and the engagement portion thereof generally corresponding with the surface 25 are substantially centrally positioned relative to the base 12 of the handle assembly 10 to the door. That is, the handle 22 extends laterally on each side of the base 12. This arrangement tends to limit the magnitude of any "off-center" loads applied to the base 12 upon opening the door. The aligned arrangement of the handle 22 also optimizes the potential size of the engagement opening for a given size handle assembly. In the illustrated embodiment, the lateral center of the handle 22 is slightly off-set from the center of the base 12, but effective limitation of off-center loads and maximization of engagement opening are still achieved.

As best shown in FIG. 2, the opening 28 is laterally offset from the base 12. This maximizes the size of the opening 28 and facilitates operation of the handle assembly 10. That is, an operator is provided with an increased or maximized opening size since the opening is not unnecessarily reduced by the base 12.

As shown in FIG. 2, the positioning of the handle 22 and base 12 permits the handle assembly 10 to be mounted close to the swinging edge of the door. That is, the handle 22 extends to the left of the base 12 to locate the opening 28 near the swinging edge of the door. The the base 12 is positioned slightly to the right of the center of the handle 22 to enable mounting on a door's reinforced area while avoiding mounting at the door edge per se. Of course, the door is more easily operated by maximizing the lateral spacing between the hinged edge of the door and the handle assembly.

The distal end 26 of the handle 22 provides a reentrant surface portion 30 along the surface 25. The reentrant surface portion 30 extends at an angle relative to the major portions of the surface 25, but may be smoothly joined thereto as shown. The reentrant portion 30 engages the wrist or forearm of an operator and provides a surface that the operator may work against as the door is moved to the open position. More particularly, as the door is pivoted open, the operator's wrist or forearm may engage or work against the reentrant portion 30 to limit radial or lateral movement of the wrist or forearm relative to the handle assembly 10. After the door is open, the operator may disengage the reentrant portion 30 by reducing the engagement pressure and allowing the wrist or forearm to slide freely along the surface to ultimately release the handle assembly 10. In this manner, the handle assembly 10 provides positive opening operation and easy release.

Figure 6:
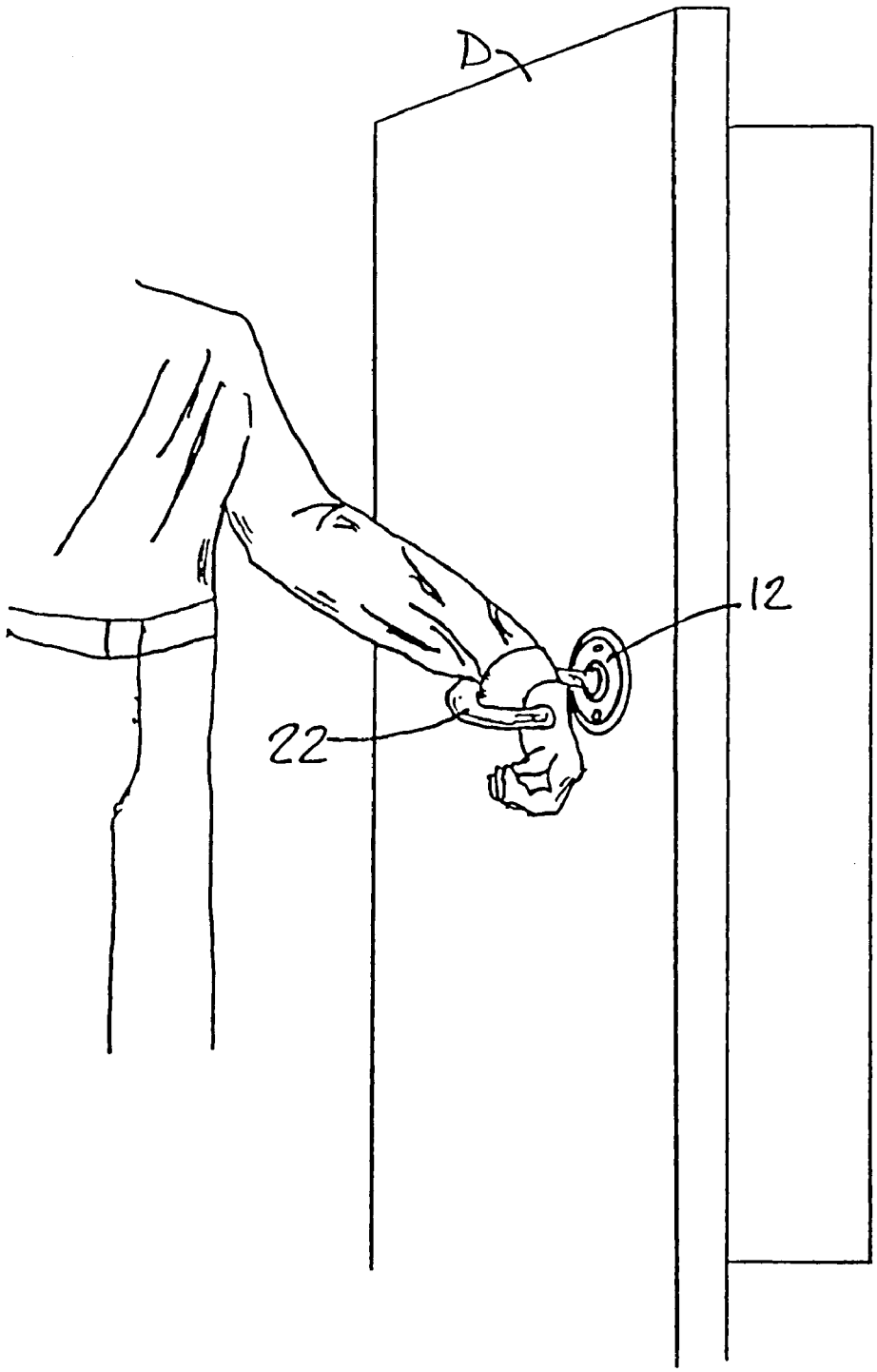
FIG. 6 is a perspective view of a door equipped with the handle assembly of the invention, showing a person pulling the door open with his wrist.

Referring to FIG. 6, the door "D" is shown being opened by engagement of an operator's wrist with the handle 22 of the assembly 12. As shown, the handle 22 is pulled toward the operator with following opening movement of the door. When the door is opened sufficiently wide to allow operator passage into the door opening, the operator slides his wrist from its engaged position with the handle 22 and from within the gap defined by the assembly 12.

In a modified arrangement, it is also possible to accommodate limited downward rotation of the handle assembly to allow shorter or weaker individuals to more easily engage and release the handle. This may be accomplished by providing a limited-rotation joint of conventional design at elbow 24, such that handle 22 can pivot downwardly about the axis of stem 20 by 15 to 25 degrees before being arrested. A range of rotation of 10 to 40 degrees is workable, but a range of 15 to 25 degrees is preferred. Alternatively, a similar limited-rotation joint can be provided in base 12 between the base and base leg 18, such that the handle 22 and L-shaped mounting arm 16 can pivot downwardly together. The joint, regardless of its location, is spring-loaded so that the handle will return to its generally horizontal position when released.

Figure 7:
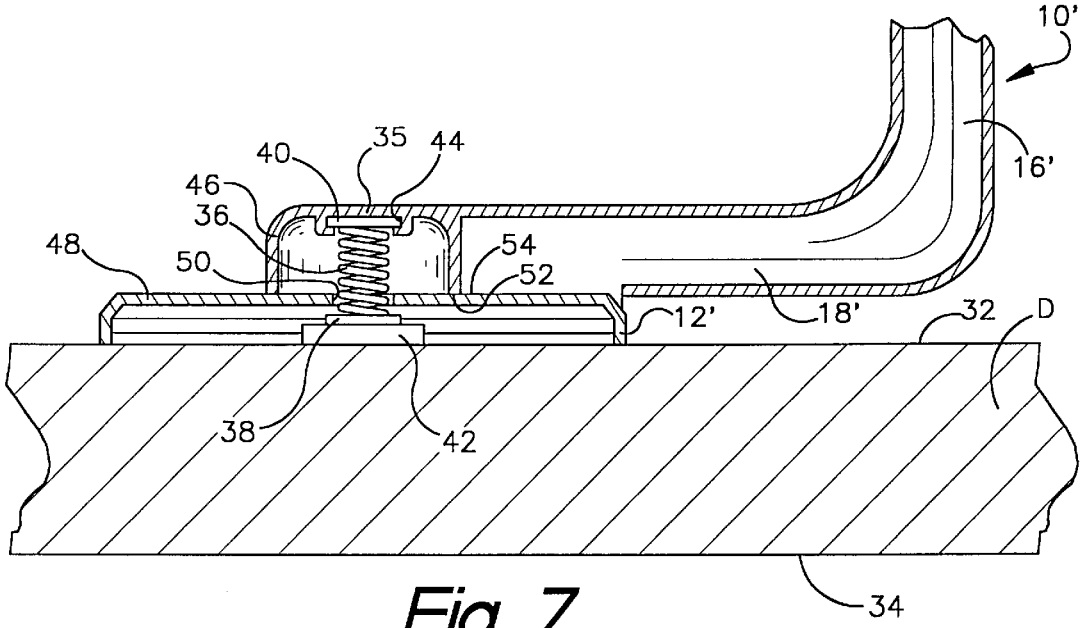
FIG. 7 is a fragmentary sectional view on an enlarged scale showing the lower portion of the handle assembly having a modified mounting arm and base connection in accordance with another embodiment of the invention.

Referring to FIG. 7, another embodiment of the invention is shown. For convenience, the same reference numerals are used for corresponding elements but with the addition of a prime designation.

As shown in FIG. 7, the lower portion of a handle assembly 10' includes a mounting arm 16' secured to the door D having a first face 32 and an opposite face 34. As in prior embodiments, the mounting arm 16' includes a base 12' that is mounted to the door at a support location adjacent the face 32.

The mounting arm 16' is secured at it proximal portion 35 to the base 12' by a spring 36. The spring 36 includes end caps 38 and 40 respectively fixed to a base mounting pedestal 42 and an arm mounting slot 44 integrally formed in a mounting hub 46 adjacent the end of the base leg 18'. The end caps 38 and 40 are securely fixed to the ends of the spring 36 in any suitable manner as by a friction or interference fit, adhesives or mechanical fasteners. Similarly, the end caps may be secured to their associated assembly elements in any suitable manner including mechanical interlocking or entrapment, adhesives or mechanical fasteners.

The base 12' includes a mounting wall 48 having a bore 50 through which the spring 36 extends with clearance. The mounting hub 46 has a cylindrical shape and includes an annular end face 52 which is biased against a base mounting face 54 surrounding the opening 50. As shown in FIG. 7, the engaging faces 52 and 54 are flat or planar, and the spring 36 tends to maintain the assembly 10' in the illustrated normal position. That is, the assembly 10' is in a stable position projecting from the face 32 due to the spring force biasing the handle 16' and base 12' together.

The tension strength of the spring 36 is sufficient to allow operation of the handle assembly 10' to open the door as described above without extension of the spring 36. That is, an operator adjacent face 32 of the door may engage the handle 16' with his wrist or forearm and pull the door towards him to an open position without relative movement of the assembly 10' with respect to the door.

The spring 36 enables the displacement of the assembly 10' to accommodate an engaged wrist or forearm if the door is unexpectedly biased open by another adjacent the door face 34. More particularly, the annular face 52 of the mounting hub 46 may tip or pivot to an inclined orientation with at least disengagement of the faces 52 and 54. In this manner, the assembly 10' and the handle 16' are displaced in response to loads applied to the wrist or forearm due to the unexpected opening of the door by another. Such accommodating movement of the assembly tends to avoid injury of the operator and permits withdrawal of his wrist or forearm from engagement without injury.

Upon operator disengagement of the assembly 10' following such unexpected opening of the door, the spring 36 operates to return the assembly 10' and the handle 16' to their normal positions projecting from the door with the faces 52 and 54 in full engagement along the planar surfaces thereof. In other words, the spring 36 tends to return the displaced or pivoted mounting hub 46 to its upright position as shown in FIG. 7. The relative rotational position of the handle 22' and the base 12' may be assured by cam surfaces or a detent.

It should be appreciated that the spring 36 may be replaced by a polymeric member such as an elastomer column or a strap connector having suitable resiliency characteristics. For example, polyurethane, natural rubber or synthetic rubber materials may be used. The spring 36 itself could be a coil, leaf or any equivalent. Other resilient members would include the polymeric member, mechanical, magnetic, hydraulic or pneumatic devices or other devices known to one skilled in the art.

Figure 8:
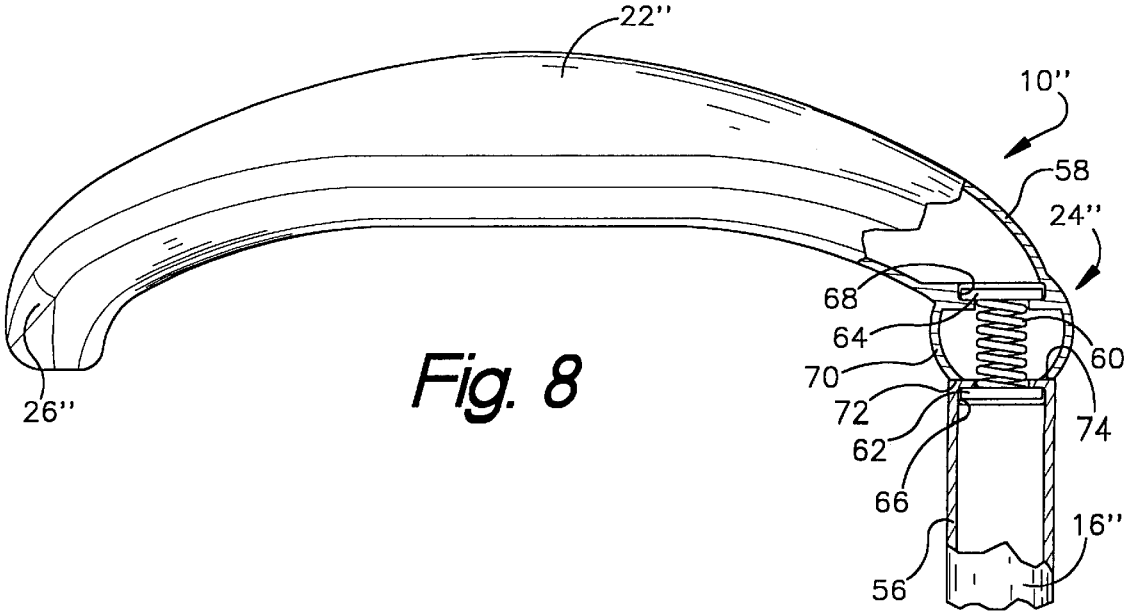
FIG. 8 is a fragmentary sectional view on an enlarged scale showing a modified handle and mounting arm resiliently connected in accordance with a further embodiment of the invention.

Referring to FIG. 8, another embodiment of the invention is shown. Once again, the same reference numerals are used for corresponding elements but with the addition of a double prime designation.

The upper portion of a handle assembly 10" includes a mounting arm 16" secured at its distal portion 56 to a proximal portion 58 of handle 22" by a spring 60. The spring 60 is mounted in the region of the elbow 24" and includes end caps 62 and 64. The end cap 62 is fixed within a mounting slot 66 in the distal portion 56 of the mounting 16". The end cap 64 is fixed in a mounting slot 68 in the proximal portion 58 of the handle 22". End caps 62 and 64 are secured to the spring 60 and to their associated elements in suitable manners as described above.

The elbow 24" includes a bulbous hub 70 having an annular face 72 seated against a mounting face 74. The spring 60 is stressed to bias the faces 72 and 74 together. The engaging faces 72 and 74 are flat or planar and tend to retain the handle 22" in a normal operating position with respect to the mounting arm 16" due to the biasing force of the spring 60.

The spring 60 is of sufficient tension strength to enable door opening operation of the assembly 10" without relative movement of the handle 22" and the mounting arm 16". As described with respect to the last embodiment, the spring 60 allows displacement of the handle 22" to accommodate an engaged wrist or forearm if the door is unexpectedly opened by another. Following such accommodating displacement, the handle 22" may be returned to its proper relative orientation and normal position by the spring 60 and the optional use of cam surfaces or a detent. The spring 60 could be any resilient member as discussed above with regard to spring 36.

The assembly 10" may be mounted to the door using the mounting base 12 of the first embodiment or the base 12' of the embodiment of FIG. 7. Accordingly, displacement may include one or two pivot locations.

In accordance with the invention, the handle assembly preferably is constructed of stainless steel, although aesthetic aluminum, brass, bronze, copper, acrylic, crystal and glass may be suitable alternatives, depending on the application. The surface of the handle assembly preferably is smooth and non-porous so as not to be permeable to germs and other pathogens.

The handle assembly is readily interchangeable with existing hardware in most applications. It can be attached directly to the door surface in place of a conventional handle, or to an existing faceplate. It is intended for use on a door with an automatic closing mechanism, which closes the door following wrist release. Accessory door lock mechanisms can be installed separately where desired.

A door latch mechanism need not be used but, if desired, it preferably should be of the spring-loaded ball or roller type, such as those disclosed in U.S. Pat. Nos. 2,439,057 and 2,541,720, which are incorporated herein by reference. This negates the need for any unlatching mechanism which would require rotation by hand. Alternatively, the handle assembly may be adapted to operate conventional door latching mechanisms. This can be accomplished by providing a latch-pulling cable (not shown) that runs within a hollow mounting arm 16 from ballshaped elbow 24. Downward rotation of handle 22 would pull the cable to unlatch the door, and the spring-loaded return would bring the parts back to their normal starting positions.

Preferably the handle assembly is installed on a door at a height which will allow comfortable engagement by a wrist or forearm. One such position, e.g., standard doorknob height, allows for engagement with the forearm in a lowered position. If mounted higher, the handle would be engaged with the forearm in a raised position. The opening 28 of the handle assembly preferably faces the free edge of the door, i.e., the edge of the door which is not hinged, so as to accommodate easy disengagement and passage once the door is pulled open.

Left and right versions of the handle assembly are required, one being the mirror image of the other, so as accommodate installation on left and right hand doors.

Use of the handle can be universal, although its primary applications will be for commercial, hospital/medical and residential applications where any hand, skin or other human contact is not desired. Other applications may include the doors of public restrooms, and doors in general in any location.

From the foregoing it can be seen that the door handle assembly of the invention provides a simple, effective and economical solution to the unsanitary situation presented by conventional door handles. The door handle assembly of the invention is intuitive, i.e., its operation is readily apparent from its design, and it is comfortable and natural to use.

The embodiments described above are exemplary, and are not limiting. Modifications will be apparent to those skilled in the art. For example, the shape of mounting arm 16 can vary from what is shown in the drawing, as long as it supports handle 22 in proper position relative to the door, and allows for wrist or forearm engagement of dished surface 25, and easy disengagement through gap 28. Mounting arm 16 could even be curved in its entirety, with the "distal end" of stem 20 blending seamlessly into handle 22. Other modifications will be apparent to those skilled in the art without departing from the true scope of the invention, which is limited only by the appended claims.

What is claimed is:

1. A door and sanitary door opener assembly for opening said door, said door having an inner hinged edge and a laterally spaced outer swinging edge, and generally parallel faces extending between said edges, said assembly comprising:

a mounting arm having a proximal portion supported at a support location on one face of said door and a distal end spaced from said one face of said door; and a handle joined to said distal end of said mounting arm at a place laterally extending past said support location toward said inner hinged edge, the handle further including a handle engagement portion, one end of the handle extending laterally past said support location toward said outer swinging edge of said door to a distal end of the handle which is spaced from said one face of said door, said engagement portion of said handle and said one face of said door defining therebetween a gap at least large enough to permit an operator's hand to pass therethrough, said engagement portion of said handle having a side facing said one face of said door for engagement by the operator's wrist or forearm when pulling said door open and for disengagement when the door is open.

2. A door and opener assembly according to claim 1, wherein said handle side facing said one face of said door includes a reentrant portion for engagement by the operator's wrist or forearm.

3. A door and opener assembly according to claim 2 wherein said reentrant portion comprises an angular extension of said handle side.

4. A door and opener assembly according to claim 2, wherein said engagement portion of said handle extends in a plane that is oblique to said one face of said door.

5. A door and opener assembly according to claim 4, wherein said plane extends downwardly from said distal portion of said mounting arm.

6. A door and opener assembly according to claim 4, wherein said plane extends at an angle of from about 15 to about 165 degrees from the vertical.

7. A door and opener assembly according to claim 6, wherein said side of said engagement portion of said handle is concave with respect to said one face of said door.

8. A door and opener assembly according to claim 7, wherein said engagement portion has a length equal to from about 2 to about 8 times the extent of the concavity of said side as measured along said engagement portion.

9. A door and opener assembly according to claim 8, wherein said mounting arm comprises a base at said proximal portion, a base leg extending from said base laterally toward said hinged edge of said door to an inner end, a stem extending generally perpendicular to said one face of said door from said inner end of said base leg to said handle at said distal portion of said mounting arm.

10. A door and opener assembly according to claim 1, wherein said assembly includes resilient means for maintaining said assembly in a normal position during opening operation of said door from said one face by the operator and for yielding to allow movement of said assembly to a displaced position tending to accommodate the operator's engaged wrist or forearm upon opening operation of said door by another from said other face and to thereby avoid injury of the operator.

11. A door and sanitary door opener assembly for opening said door, said door having an inner hinged edge, an outer swinging edge and faces extending between said edges, said assembly comprising:

a mounting arm supported at a support location, the mounting arm having a proximal portion supported on one face of said door, and a distal end spaced from said one face of said door; and a handle joined to said distal end of said mounting arm and extending outwardly toward said outer swinging edge of said door to a free end spaced from said one face of said door, said free end of said handle and said one face of said door defining therebetween a gap at least large enough to permit an operator's hand to pass therethrough, the end of the handle joined to the mounting arm being located between the support location and said inner hinged edge, said handle being arcuate with the dished side thereof generally facing said one face of said door for natural engagement by the operator's wrist or forearm when pulling said door open, and natural disengagement when said door is open.

12. A door and opener assembly according to claim 11, wherein said free end of said handle and said distal portion of said mounting arm are substantially equidistant from said one face of said door.

13. A door and opener assembly according to claim 11, wherein the plane of the arc of said handle is oblique to said one face of said door.

14. A door and opener assembly according to claim 13, wherein said mounting arm comprises a base at said proximal portion thereof, said mounting arm extending from said base inwardly toward said inner hinged edge of said door and away from said one face of said door to said distal portion.

15. A door and opener assembly according to claim 14, wherein said base lies between the projection on said one face of said door of said distal portion of said mounting arm, and the projection on said one face of said door of said free end of said handle.

16. A door and opener assembly according to claim 15, wherein said mounting arm comprises a base leg extending from said base generally parallel to said one face of said door and inwardly toward said inner hinged edge of said door to an inner end, and a stem extending generally perpendicular to said one face of said door from said inner end of said base leg to said handle at said distal portion of said mounting arm.

17. A sanitary door opener assembly adapted for mounting on and opening a door having an inner hinged edge, an outer swinging edge and faces extending between said edges, said assembly comprising:

a mounting arm having a proximal portion and a distal end, said proximal portion having a base with a mounting surface adapted to be supported on one face of the door, said distal end being spaced from the plane of said mounting surface so that said distal end of the mounting arm is spaced from said one surface of the door when said base in supported thereon; and a handle joined to said distal end of said mounting arm and including an engagement portion extending therefrom to a free end spaced from the plane of said mounting surface by a distance greater than the width of an operator's hand, whereby when said assembly is mounted on the door said free end of said handle and said one face of said door define therebetween a gap at least large enough to permit the operator's hand to pass therethrough, with said free end of said handle projecting toward the outer swinging edge of the door, said assembly including resilient means for maintaining said assembly in a normal position during opening operation of said door from said one face by the operator and for yielding to allow movement of said assembly to a displaced position tending to accommodate the operator's engaged wrist or forearm upon opening operation of said door by another from said other face and to thereby avoid injury of the operator, said engagement portion of said handle having a side facing said one face of said door for engagement by the operator's wrist or forearm when pulling said door open and for disengagement when the door is open.

18. A sanitary door opener assembly according to claim 17, wherein said resilient means comprise a coil spring or a polymeric connector.

19. A door opener assembly according to claim 20, wherein said mounting arm comprises a base leg extending from said base generally parallel to the plane of said mounting surface to an inner end, and a stem extending generally perpendicular to the plane of said mounting surface from said inner end of said base leg to said handle at said distal end of said mounting arm.

20. A door and sanitary door opener assembly for opening said door, said door having an inner hinged edge and a laterally spaced outer swinging edge, and first and second faces extending between said edges on opposite sides of said door, said assembly comprising:

a mounting arm member having a proximal portion supported at a support location on one face of said door and a distal end spaced from said one face of said door; and a handle member joined to said distal end of said mounting arm including a handle engagement portion extending laterally toward said outer swinging edge of said door to a distal end of the said handle spaced from said one face of said door, said engagement portion of said handle and said one face of said door defining therebetween a gap at least large enough to permit an operator's hand to pass therethrough, said engagement portion of said handle having a side facing said one face of said door for engagement by the operator's wrist or forearm when pulling said door open and for disengagement when the door is open, said assembly including a resilient member for maintaining said assembly in a normal position during opening operation of said door from said one face by the operator and for yielding to allow movement of said assembly to a displaced position tending to accommodate the operator's engaged wrist or forearm upon opening operation of said door by another from said other face and to thereby avoid injury of the operator.

21. A door and opener assembly according to claim 20, wherein said resilient member is arranged to mount at least one of said mounting arm and handle members for movement relative to said one face to said displaced position in response to loads applied to the operator's wrist or forearm engaged with said assembly when said door is opened by another from said other face.

22. A door and opener assembly according to claim 20, wherein said resilient member comprises a coil spring or a polymeric connector or other resilient means.

23. A door and opener assembly according to claim 20, wherein said mounting arm member includes a base joined to said door and said mounting arm is connected to said base by said resilient member.

24. A door and opener assembly according to claim 23, wherein said mounting arm member includes a proximal mounting arm face and said base includes a base face, said proximal mounting arm face and said base face being in engagement when said handle assembly is in said normal position and being pivotally movable when said arm mounting member is moved to said displaced position with deflection of said resilient member.

25. A door and opener assembly according to claim 20, wherein said handle member is connected to said mounting arm member by said resilient member.

26. A door and opener assembly according to claim 25, wherein said mounting arm member includes a distal mounting arm face and said handle member includes a handle face, said distal mounting arm face and handle face being in engagement when said assembly is in said normal position and being pivotally movable when said handle member is moved to said displaced position with deflection of said resilient member.

27. A door and sanitary door opener assembly for opening said door, said door having an inner hinged edge and a laterally spaced outer swinging edge, and faces extending between said edges, said assembly comprising:

a mounting arm having a proximal portion supported at a support location on one face of said door and a distal end spaced from said one face of said door; and a handle joined to said distal end of said mounting arm including a handle engagement portion extending laterally past said support location toward said outer swinging edge of said door to a distal end spaced from said one face of said door, said engagement portion of said handle and said one face of said door defining therebetween a gap at least large enough to permit an operator's hand to pass therethrough, said engagement portion of said handle having a side facing said one face of said door for engagement by the operator's wrist or forearm when pulling said door open and for disengagement when the door is open, said engagement portion of said handle extending in a plane that is oblique to said one face of said door.

28. A door and opener assembly according to claim 27, wherein said plane extends downwardly from said distal portion of said mounting arm.

29. A door and opener assembly according to claim 27, wherein said plane extends at an angle of from about 15 to about 165 degrees from the vertical.

30. A door and opener assembly according to claim 29, wherein said side of said engagement portion of said handle is concave with respect to said one face of said door.

31. A door and opener assembly according to claim 30, wherein said engagement portion has a length equal to from about 2 to about 8 times the extent of the concavity of said side as measured along said engagement portion.

32. A door and opener assembly according to claim 27, wherein said assembly includes resilient means for maintaining said assembly in a normal position during opening operation of said door from said one face by the operator and for yielding to allow movement of said assembly to a displaced position tending to accommodate the operator's engaged wrist or forearm upon opening operation of said door by another from said other face and to thereby avoid injury of the operator.

* * * * *